US012577645B2

(12) United States Patent
Furusho et al.

(10) Patent No.: US 12,577,645 B2
(45) Date of Patent: Mar. 17, 2026

(54) NON-MAGNETIC AUSTENITIC STAINLESS STEEL MATERIAL AND PRODUCTION METHOD THEREFOR

(71) Applicant: Daido Steel Co., Ltd., Nagoya (JP)

(72) Inventors: Chihiro Furusho, Nagoya (JP); Yoshihiko Koyanagi, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 2 days.

(21) Appl. No.: 18/142,803

(22) Filed: May 3, 2023

(65) Prior Publication Data

US 2023/0366072 A1 Nov. 16, 2023

(30) Foreign Application Priority Data

May 10, 2022 (JP) ..... 2022-077769

(51) Int. Cl.
*C22C 38/58* (2006.01)
*C21D 9/08* (2006.01)
(Continued)

(52) U.S. Cl.
CPC ..... *C22C 38/58* (2013.01); *C21D 9/085* (2013.01); *C22C 38/001* (2013.01);
(Continued)

(58) Field of Classification Search
CPC ..... C21D 1/02; C21D 1/18; C21D 2211/001; C21D 6/004; C21D 6/005; C21D 7/13;
(Continued)

(56) References Cited

U.S. PATENT DOCUMENTS

2005/0189045 A1 9/2005 Takayama et al.
2005/0194073 A1 9/2005 Hamano et al.
(Continued)

FOREIGN PATENT DOCUMENTS

CN 108138280 A 6/2018
CN 109072377 A 12/2018
(Continued)

OTHER PUBLICATIONS

EP-EESR in European Patent Application No. 23172273.7 on Oct. 23, 2023.
(Continued)

*Primary Examiner* — Jie Yang
(74) *Attorney, Agent, or Firm* — McGinn I.P. Law Group, PLLC

(57) ABSTRACT

The present invention relates to a non-magnetic austenitic stainless steel material having a component composition containing, in terms of mass percent, C: <0.10%, Si: <0.3%, Mn: more than 4.5% to less than 10.0%, P: <0.05%, S: <0.0020%, Ni: 9.0% to 15.0%, Cr: 17.0% to 25.0%, Mo: 3.0% to 7.0%, and N: 0.3% to 0.6%, with the balance being Fe and unavoidable impurities; satisfying $(40[N]+1.2[Cr]+0.07\exp(0.3[Ni]+0.3[Cu]))\times 1.5[Mo]^{(-0.18)}\leq 60$, in which [M] represents a content of an element M in terms of mass %; having an austenite single phase structure; having a critical pitting temperature of 50° C. or higher; and having a 0.2% proof stress of 970 MPa or more.

17 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01)

(58) Field of Classification Search
CPC .. C21D 8/0205; C21D 8/0226; C21D 8/0231; C21D 8/105; C21D 9/08; C21D 9/085; C21D 9/46; C22C 38/001; C22C 38/002; C22C 38/02; C22C 38/04; C22C 38/06; C22C 38/42; C22C 38/44; C22C 38/46; C22C 38/48; C22C 38/50; C22C 38/52; C22C 38/54; C22C 38/58
See application file for complete search history.

(56) References Cited

U.S. PATENT DOCUMENTS

| | | | | |
|---|---|---|---|---|
| 2008/0060727 | A1 | 3/2008 | Takayama et al. | |
| 2008/0202652 | A1 | 8/2008 | Takayama et al. | |
| 2017/0029911 | A1* | 2/2017 | Dan | C22C 38/001 |
| 2018/0258505 | A1 | 9/2018 | Hirata et al. | |
| 2019/0112694 | A1 | 4/2019 | Takagi et al. | |
| 2022/0033924 | A1 | 2/2022 | Fluch et al. | |
| 2022/0145436 | A1* | 5/2022 | Fluch | C21D 8/0236 |
| 2023/0332282 | A1 | 10/2023 | Fluch et al. | |
| 2024/0052469 | A2* | 2/2024 | Fluch | C21D 6/005 |

FOREIGN PATENT DOCUMENTS

| | | | |
|---|---|---|---|
| CN | 110117746 | A | 8/2019 |
| JP | S64-056858 | A | 3/1989 |
| JP | H02-057668 | A | 2/1990 |
| JP | H05-065601 | A | 3/1993 |
| JP | H07-026350 | A | 1/1995 |
| JP | H08-269632 | A | 10/1996 |
| JP | H09-279315 | A | 10/1997 |
| JP | 2005-281856 | A | 10/2005 |
| JP | 2009-030139 | A | 2/2009 |
| JP | 2020-196912 | A | 12/2020 |
| JP | 2022-514920 | A | 2/2022 |

OTHER PUBLICATIONS

Chinese Office Action, dated May 23, 2025 in Chinese Application No. 202310521179.4 and English Translation Thereof.
Chinese Office Action dated Oct. 24, 2025 for Chinese Patent Application No. 202310521179.4 with machine English translation.
Japanese Office Action dated Dec. 12, 2025 in Japanese Patent Application No. 2022-077769 with machine English translation.
Chinese Office Action dated Jan. 9, 2026 in Chinese Patent Application No. 202310521179.4 with English tranlation.
"Practical Steel Rolling Technology Handbook", Yang Zongyi, p. 99, Metallurgical Industry Press, Apr. 30, 1995 with English translation.

* cited by examiner

NON-MAGNETIC AUSTENITIC STAINLESS STEEL MATERIAL AND PRODUCTION METHOD THEREFOR

CROSS-REFERENCE TO RELATED APPLICATIONS

This application is based on and claims priority under 35 USC 119 from Japanese Patent Application No. 2022-077769 filed on May 10, 2022, the contents of which are incorporated herein by reference.

TECHNICAL FIELD

The present invention relates to a non-magnetic austenitic stainless steel material having excellent strength and corrosion resistance, and a production method therefor.

BACKGROUND ART

Austenitic stainless steel materials such as SUS304 have been used as steel materials for parts that require strength and corrosion resistance.

For example, Patent Literature 1 states that known high-strength and high-corrosion-resistant stainless steel materials added with a large amount of nitrogen contain large amounts of expensive alloying elements such as Cr, Ni, and Mo, and a solid-solution treatment should be performed at a high temperature near 1,200° C. to transform nitrides, which adversely influence cold workability, into a solid-solution state, which makes the cost very high. Then, Patent Literature 1 discloses an austenitic stainless steel material whose strength has been improved by cold working and which has excellent corrosion resistance. In general, the cold working reduces the corrosion resistance, but in Patent Literature 1, Cu is added to a component composition for the purpose of improving the cold workability and one or more of Nb, V, and W is added to the component composition for the purpose of improving the strength, thereby improving both the strength and the corrosion resistance.

On the other hand, non-magnetic austenitic stainless steel materials have been also used as steel materials for a drill collar and other attached parts of drills for oil and gas rig in a submarine oil field to have strength and corrosion resistance, and not to influence position control of a drill bit by magnetism.

For example, Patent Literature 2 discloses a method for producing a forged product, including a drill collar, made of a non-magnetic austenitic stainless steel material. In the steel material having the component composition used in Patent Literature 2, since a precipitate such as a carbide or a nitride is likely to precipitate in a temperature range of 740° C. to 760° C., a steel ingot is subjected to warm working at a surface temperature between 650° C. and 500° C. to prevent precipitation of a precipitate such as a carbide or a nitride at a grain boundary, and to sufficiently provide C and N in an austenite crystal grain, thereby obtaining excellent strength and corrosion resistance.

Patent Literature 1: JP H08-269632A

Patent Literature 2: JP 2009-30139A

SUMMARY OF THE INVENTION

The steel material for a drill collar and other attached parts of drills for oil and gas rig is required to have, in addition to strength and corrosion resistance, a more stable austenite single phase structure such that the steel material does not become magnetized even in a more severe use environment, that is, does not cause work-induced martensite transformation.

The present invention has been made in view of the above circumstances, and an object thereof is to provide a non-magnetic austenitic stainless steel material having excellent strength and corrosion resistance suitable for machine members to be used in a corrosive environment, particularly for a drill collar of drills for oil and gas rig and the like, and a production method therefor.

A non-magnetic austenitic stainless steel material according to the present disclosure:

- has a component composition containing, in terms of mass percent, C: <0.10%, Si: <0.3%, Mn: more than 4.5% to less than 10.0%, P: <0.05%, S: <0.0020%, Ni: 9.0% to 15.0%, Cr: 17.0% to 25.0%, Mo: 3.0% to 7.0%, and N: 0.3% to 0.6%, with the balance being Fe and unavoidable impurities;
- satisfies $(40[N]+1.2[Cr]+0.07\exp(0.3[Ni]+0.3[Cu]))\times 1.5[Mo]^{(-0.18)}\leq 60$, in which [M] represents a content of an element M in terms of mass %;
- has an austenite single phase structure;
- has a critical pitting temperature (CPT) of 50° C. or higher in a test method according to Method C in ASTM G48; and
- has a 0.2% proof stress of 970 MPa or more at a position at a depth of 1 inch from a surface in the case where a thickness T or a diameter D is 4 inches or more, or at a position at a depth of T/4 or D/4 from the surface in the case where the thickness T or the diameter D is less than 4 inches.

According to such characteristics, suitable corrosion resistance can be obtained and high strength can be maintained even in a corrosive environment, and stable non-magnetic performance can be obtained.

In addition, a method for producing a non-magnetic austenitic stainless steel material according to the present disclosure is a method for producing a non-magnetic austenitic stainless steel material:

- having a component composition containing, in terms of mass percent, C: <0.10%, Si: <0.3%, Mn: more than 4.5% to less than 10.0%, P: <0.05%, S: <0.0020%, Ni: 9.0% to 15.0%, Cr: 17.0% to 25.0%, Mo: 3.0% to 7.0%, and N: 0.3% to 0.6%, with the balance being Fe and unavoidable impurities;
- satisfying $(40[N]+1.2[Cr]+0.07\exp(0.3[Ni]+0.3[Cu]))\times 1.5[Mo]^{(-0.18)}\leq 60$, in which [M] represents a content of an element M in terms of mass %;
- having an austenite single phase structure;
- having a critical pitting temperature (CPT) of 50° C. or higher in a test method according to Method C in ASTM G48; and
- having a 0.2% proof stress of 970 MPa or more at a position at a depth of 1 inch from a surface in the case where a thickness T or a diameter D is 4 inches or more, or at a position at a depth of T/4 or D/4 from the surface in the case where the thickness T or the diameter D is less than 4 inches. The method includes subjecting a steel ingot having a predetermined component composition to hot working followed by a cooling treatment, and performing warm working at an area reduction rate of 15% to 50% in a temperature range of 800° C. to 300° C. during the cooling treatment.

According to such characteristics, a non-magnetic austenitic stainless steel which has suitable corrosion resistance and can maintain high strength even in a corrosive environment, and which has stable non-magnetic performance can be obtained.

DESCRIPTION OF EMBODIMENTS

Figure 1A:
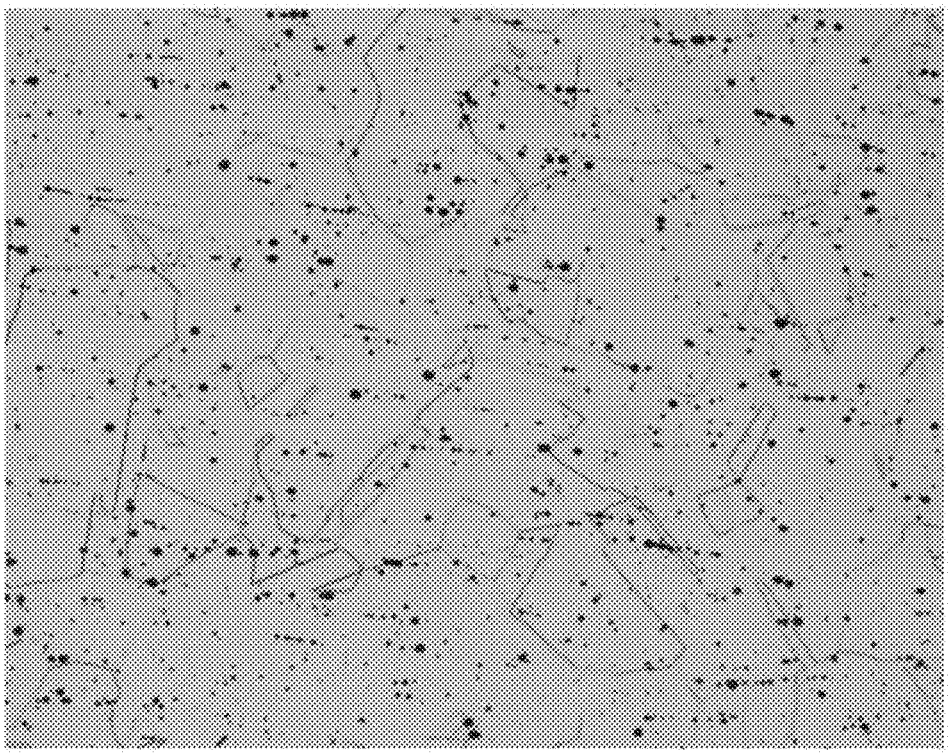
FIG. 1A shows a photomicrograph of a stepped structure after a sensitization test.

A non-magnetic austenitic stainless steel material and a production method therefor will be described as an embodiment according to the present invention.

A target austenitic stainless steel material is made of a steel containing, in terms of mass %, C: <0.10%, Si: <0.3%, Mn: more than 4.5% to less than 10.0%, P: <0.05%, S: <0.0020%, Ni: 9.0% to 15.0%, Cr: 17.0% to 25.0%, Mo: 3.0% to 7.0%, and N: 0.3% to 0.6%. Such a component composition can provide a non-magnetic steel as an austenite single phase structure.

In particular, the content of each component is adjusted so as to satisfy the following expression 1.

$$(40[N]+1.2[Cr]+0.07\quad \exp(0.3[Ni]+0.3[Cu]))\times 1.5[Mo]^{(-0.18)}\leq 60 \qquad \text{(Expression 1)}$$

This relational expression (expression 1) is what the present inventors found as a condition of the component composition capable of delaying the start of sensitization when they performed a sensitization test (according to Practice A in ASTM A262). In the sensitization test, as the amount of Cr-based nitrides at a grain boundary decreases, the structure changes from a Ditch structure to a Dual structure to a Step structure. From the viewpoint of corrosion resistance, it is preferable to exhibit a Dual structure or a Step structure. Here, in general, when warm working, which will be described later, is performed, a Cr-based carbide or nitride is precipitated at the grain boundary, and sensitization tends to occur. However, in the case where the expression 1 is satisfied, the sensitization start time can be delayed. That is, the obtained steel material has excellent corrosion resistance against generated harmful gases or high-temperature and high-pressure seawater during seabed excavation.

Regarding the corrosion resistance of a steel material obtained from a steel having such a component composition, a critical pitting temperature (CPT) is set to 50° C. or higher in a test method according to Method C in ASTM G48.

In addition, it is preferable that the above-described component composition further contains at least one element selected from the following Group A to Group C (where % is mass %).

Group A: at least one element selected from Nb: <0.2%, W: <1.0%, Al: <0.1%, Ti: <0.2%, V: <0.5%, and Ta: <0.2%

Group B: ≤0.0050%

Group C: at least one element selected from Ca: <0.0200%, Mg: <0.0200%, and Zr: <0.0200%

Among the elements in the Group A, the elements other than W have the effect of refining crystal grains, and W has the effect of improving corrosion resistance. In addition, the elements in the Group B and Group C segregate at grain boundaries to reduce the influence of grain boundary embrittlement elements such as P and S, and are effective for maintaining good workability in a hot working step or a warm working step. B is particularly preferred because the content can be easily adjusted.

In addition, it is also preferable that the above-described component composition is adjusted so as to further satisfy the following expression 2.

$$756-555[C]-528[N]-10.3[Si]-12.5[Mn]-10.5[Cr]-24[Ni]-5.6[Mo]\leq -110 \qquad \text{(Expression 2)}$$

In the case where such a relational expression (expression 2) is satisfied, it is possible to obtain a stable austenite single phase structure in which work-induced martensite transformation can be prevented and which is effective for maintaining non-magnetism.

It is also preferable that the above-described component composition is adjusted so as to further satisfy the following expression 3.

$$48\leq [Cr]+1.27[Ni]+3.2[Mo]+5.45[Cu] \qquad \text{(Expression 3)}$$

In the case where such a relational expression (expression 3) is satisfied, the corrosion resistance of the obtained steel material can be further improved.

A method for producing the non-magnetic austenitic stainless steel is as follows. First, a steel ingot having a predetermined component composition so as to obtain the above-described component composition is subjected to hot working such as hot forging or rolling. Further, a solid-solution treatment is performed as necessary. In the present embodiment, during a cooling treatment after the hot working, or during a cooling treatment after the solid-solution treatment in the case where the solid-solution treatment is performed, warm working is further performed in a temperature range of 800° C. to 300° C. in a cooling process. The cooling treatment is preferably quenching, and can be blast cooling (air cooling), gas cooling, water cooling, oil cooling, or the like, from the viewpoint of preventing precipitation of a precipitate such as a carbide or a nitride at the grain boundary. In the warm working, working at an area reduction rate of a cross-sectional area of 15% to 50% is applied. Accordingly, the inside of the steel material can be work-hardened, and the inside can be made to have high strength even for a thick member having a thickness of 2 inches or more. Thus, in the case where a thickness T or a diameter D of the steel material is less than 4 inches, a 0.2% proof stress at a position at a depth of T/4 or D/4 from the surface can be set to 970 MPa or more, and in the other cases, the 0.2% proof stress at a position at a depth of 1 inch from the surface can be set to 970 MPa or more.

The 0.2% proof stress is measured by a tensile test. In the case of producing, as the steel material, a round bar having a diameter of less than 4 inches, a test piece is sampled such that a position at a depth of ½ radius from the surface is included in a parallel section of the tensile test piece. In the case of a member having a diameter of 4 inches or more, a test piece is sampled such that a position at a depth of 1 inch from the surface is included in the parallel section of the tensile test piece.

In particular, when warm forging is performed, in a steel material having a round bar shape with a relatively large diameter, the forging effect is higher in an outer peripheral portion than in a core portion, resulting in a warm-forged structure in which the structure is inclined from the core portion to the outer peripheral portion. Therefore, the strength around the periphery is further increased. But for example, in the case of forming a hollow cylindrical steel material such as a steel material for a drill collar of drills for oil and gas rig, boring is performed to leave the outer peripheral portion having relatively high strength.

EXAMPLES

[Simulation Test]

Next, the results of producing, by the above-described production method, test pieces simulating an austenitic stainless steel material will be described with reference to Tables 1 and 2.

As shown in Table 1, steels each having a predetermined component composition were adjusted by atmospheric melting (arc furnace melting) and electroslag remelting to obtain 6-t ingots having respective component compositions shown as Examples 1 to 17 and Comparative Examples 1 to 10. These ingots were subjected to a homogenization heat treatment at a predetermined temperature within the range of 1,100° C. to 1,250° C. and hot forged into round bars each having a diameter of 320 mm. Next, the round bars were subjected to a solid-solution treatment at a predetermined temperature within the range of 1,050° C. to 1,150° C., followed by air cooling to 750° C.

Next, warm working was started from a warm working start temperature shown in Table 2. In the warm working, the round bar was forged and stretched such that an area reduction rate of a cross-sectional area was a predetermined value within the range of 15% to 50% (see Table 2). A tensile test piece was sampled from each of the round bars such that a position at a depth of 1 inch from the surface was included in the parallel section of the test piece.

Table 2 shows test results for each of the obtained steel materials. In addition, values of the left sides of the (expression 1) and the (expression 2) and the values of the right side of the (expression 3) are also shown.

Here, a magnetic permeability measurement was performed according to ASTM A342, and the case where magnetic permeability was 1.005 or less was indicated as "A" as good, and otherwise as "C" as unsatisfactory.

In the tensile test at room temperature, the 0.2% proof stress, tensile strength, an elongation, and a reduction of area were measured. The case where all of a 0.2% proof stress of 970 MPa or more, tensile strength of 1,030 MPa or more, an elongation of 15% or more, and a reduction of area of 50% or more were satisfied was indicated as "A" as good, and otherwise as "C" as unsatisfactory, in each column of "Tensile properties".

The sensitization test was performed according to Practice A in ASTM A262. The structure was observed after immersion in a corrosive solution, and was classified into a Ditch structure (grooved structure), a Step structure (stepped structure), and a Dual structure (mixed structure), and the Ditch structure was indicated as unsatisfactory, and otherwise as good.

Figure 1B:
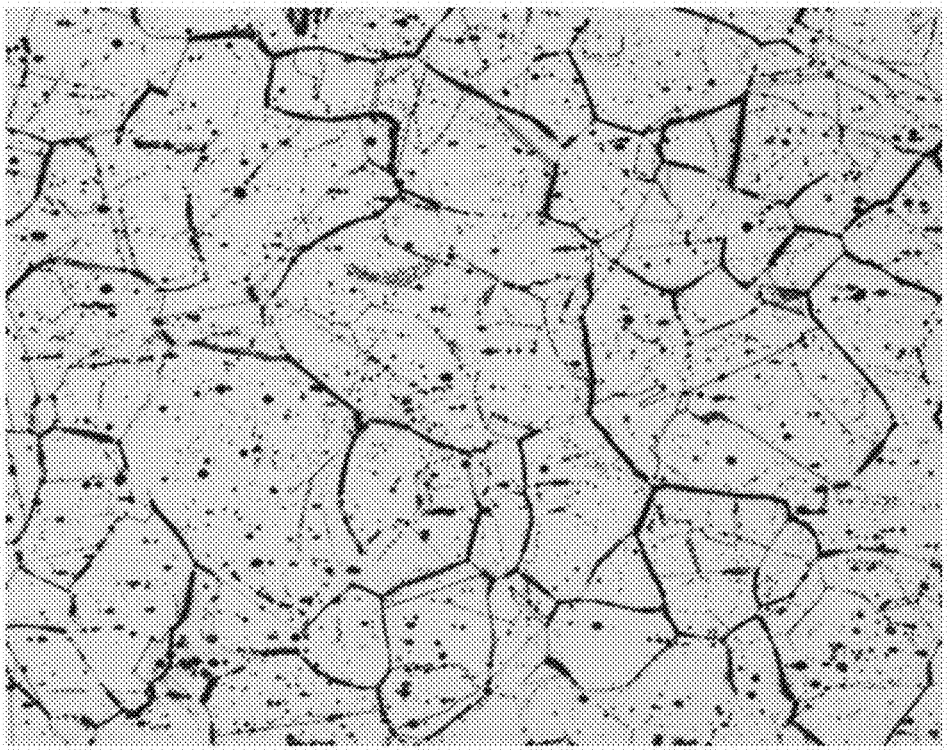
FIG. 1B shows a photomicrograph of a grooved structure after a sensitization test.

FIG. 1A shows a photomicrograph of an example of a stepped structure, and FIG. 1B shows a photomicrograph of an example of a grooved structure. In the sensitization test is observed a degree of sensitization that a precipitate such as chromium nitride is precipitated at the grain boundary by exposure to a high-temperature environment. As a result of etching, the larger the amount of the precipitate, the deeper the grain boundary corrodes and the darker the grain boundary is observed. That is, the progress of sensitization results in a grooved structure in which grain boundaries are observed black as shown in FIG. 1B, with respect to the stepped structure as shown in FIG. 1A.

The critical pitting temperature (CPT) measurement (corrosion resistance test) was performed according to Method C in ASTM G48. The CPT was measured, and the corrosion resistance was determined as good in the case where the CPT was 50° C. or higher.

TABLE 1

| No. | C | Si | Mn | P | S | Cu | Ni | Cr | Mo | Al | N |
|---|---|---|---|---|---|---|---|---|---|---|---|
| Example 1 | 0.03 | 0.11 | 5.8 | 0.02 | 0.0012 | 0.03 | 13.2 | 20.2 | 5.0 | 0.03 | 0.50 |
| Example 2 | 0.03 | 0.15 | 5.5 | 0.02 | 0.0010 | 0.10 | 13.0 | 22.6 | 5.9 | 0.02 | 0.45 |
| Example 3 | 0.03 | 0.13 | 5.5 | 0.01 | 0.0011 | 0.05 | 14.7 | 20.3 | 5.3 | 0.04 | 0.55 |
| Example 4 | 0.04 | 0.14 | 6.5 | 0.03 | 0.0008 | 0.20 | 12.8 | 20.3 | 4.6 | 0.03 | 0.44 |
| Example 5 | 0.08 | 0.11 | 6.8 | 0.02 | 0.0006 | 0.08 | 13.4 | 20.9 | 5.4 | 0.02 | 0.59 |
| Example 6 | 0.04 | 0.12 | 5.4 | 0.02 | 0.0013 | 0.06 | 13.8 | 18.8 | 4.5 | 0.03 | 0.44 |
| Example 7 | 0.03 | 0.12 | 6.0 | 0.03 | 0.0014 | 0.10 | 12.6 | 20.4 | 4.3 | 0.03 | 0.48 |
| Example 8 | 0.01 | 0.10 | 6.7 | 0.02 | 0.0010 | 0.35 | 12.8 | 21.5 | 4.9 | 0.04 | 0.57 |
| Example 9 | 0.02 | 0.11 | 6.3 | 0.02 | 0.0009 | 0.00 | 13.3 | 20.7 | 5.1 | 0.02 | 0.49 |
| Example 10 | 0.03 | 0.11 | 6.5 | 0.02 | 0.0008 | 0.21 | 14.2 | 19.9 | 5.3 | 0.03 | 0.53 |
| Example 11 | 0.04 | 0.06 | 5.5 | 0.02 | 0.0018 | 0.04 | 13.2 | 20.1 | 5.0 | 0.05 | 0.45 |
| Example 12 | 0.04 | 0.13 | 5.3 | 0.03 | 0.0009 | 0.14 | 13.9 | 20.9 | 5.2 | 0.06 | 0.40 |
| Example 13 | 0.04 | 0.16 | 5.9 | 0.01 | 0.0010 | 0.11 | 12.4 | 19.2 | 5.5 | 0.04 | 0.59 |
| Example 14 | 0.03 | 0.12 | 5.4 | 0.02 | 0.0013 | 0.17 | 12.1 | 21.5 | 4.9 | 0.03 | 0.48 |
| Example 15 | 0.02 | 0.11 | 7.6 | 0.02 | 0.0014 | 0.23 | 13.4 | 18.1 | 5.2 | 0.06 | 0.45 |
| Example 16 | 0.02 | 0.10 | 6.5 | 0.02 | 0.0011 | 0.16 | 14.7 | 21.3 | 4.2 | 0.02 | 0.44 |
| Example 17 | 0.03 | 0.14 | 5.8 | 0.01 | 0.0008 | 0.05 | 13.4 | 20.7 | 5.1 | 0.02 | 0.49 |
| Comp. Ex. 1 | 0.03 | 0.12 | 5.6 | 0.02 | 0.0011 | 0.06 | 12.8 | 19.8 | 4.9 | 0.03 | 0.52 |
| Comp. Ex. 2 | 0.04 | 0.14 | 5.9 | 0.02 | 0.0009 | 0.12 | 13.6 | 22.6 | 5.6 | 0.02 | 0.44 |
| Comp. Ex. 3 | 0.03 | 0.14 | 5.6 | 0.01 | 0.0011 | 0.22 | 14.8 | 21.9 | 4.8 | 0.04 | 0.55 |
| Comp. Ex. 4 | 0.03 | 0.10 | 4.8 | 0.02 | 0.0008 | 0.19 | 13.4 | 22.0 | 5.3 | 0.03 | 0.28 |
| Comp. Ex. 5 | 0.03 | 0.09 | 5.5 | 0.02 | 0.0005 | 0.14 | 13.5 | 22.3 | 2.9 | 0.03 | 0.53 |
| Comp. Ex. 6 | 0.03 | 0.08 | 4.2 | 0.03 | 0.0009 | 0.12 | 13.3 | 21.3 | 5.4 | 0.02 | 0.31 |
| Comp. Ex. 7 | 0.04 | 0.11 | 5.7 | 0.02 | 0.0010 | 0.13 | 13.2 | 16.5 | 5.1 | 0.03 | 0.48 |
| Comp. Ex. 8 | 0.04 | 0.13 | 5.8 | 0.03 | 0.0012 | 0.20 | 13.8 | 25.7 | 4.8 | 0.02 | 0.51 |
| Comp. Ex. 9 | 0.03 | 0.08 | 5.4 | 0.03 | 0.0009 | 0.15 | 15.3 | 22.5 | 5.3 | 0.03 | 0.53 |
| Comp. Ex. 10 | 0.01 | 0.13 | 4.9 | 0.02 | 0.0007 | 0.19 | 12.7 | 20.0 | 4.6 | 0.03 | 0.47 |

| No. | Co | Nb | Ti | V | Ta | W | B | Ca | Mg | Zr |
|---|---|---|---|---|---|---|---|---|---|---|
| Example 1 | 0.34 | — | — | — | — | — | 0.0022 | — | — | — |
| Example 2 | 0.37 | — | — | — | — | 0.33 | 0.0042 | — | — | — |
| Example 3 | 0.13 | 0.08 | — | — | — | — | 0.0024 | — | — | — |
| Example 4 | 0.19 | — | 0.05 | — | — | — | 0.0016 | — | — | — |
| Example 5 | 0.24 | — | — | 0.26 | — | — | 0.0015 | — | — | — |

TABLE 1-continued

| | | | | | | | | | | |
|---|---|---|---|---|---|---|---|---|---|---|
| Example 6 | 0.16 | — | — | — | 0.11 | — | 0.0023 | — | — | — |
| Example 7 | 0.25 | 0.07 | — | 0.12 | — | — | 0.0036 | — | — | — |
| Example 8 | 0.22 | — | 0.04 | 0.08 | — | — | 0.0027 | — | — | — |
| Example 9 | 0.20 | — | — | — | — | — | 0.0019 | — | — | — |
| Example 10 | 0.00 | — | — | — | — | — | 0.0027 | — | — | — |
| Example 11 | 0.20 | — | — | — | — | — | 0.0017 | — | — | — |
| Example 12 | 0.30 | — | — | — | — | — | — | 0.0055 | — | — |
| Example 13 | 0.30 | — | — | — | — | — | — | — | 0.0053 | — |
| Example 14 | 0.27 | — | — | — | — | — | 0.0029 | — | — | 0.018 |
| Example 15 | 0.12 | — | — | 0.14 | — | — | 0.0031 | — | 0.0045 | — |
| Example 16 | 0.33 | 0.06 | — | — | — | — | 0.0040 | — | 0.0036 | — |
| Example 17 | 0.19 | — | — | — | — | — | | — | — | — |
| Comp. Ex. 1 | 0.30 | — | — | — | — | — | 0.0031 | — | — | — |
| Comp. Ex. 2 | 0.29 | — | — | — | — | — | 0.0039 | — | — | — |
| Comp. Ex. 3 | 0.13 | — | — | — | — | — | 0.0029 | — | — | — |
| Comp. Ex. 4 | 0.08 | — | — | — | — | — | 0.0018 | — | — | — |
| Comp. Ex. 5 | 0.10 | — | — | — | — | — | 0.0024 | — | — | — |
| Comp. Ex. 6 | 0.09 | — | — | — | — | — | 0.0026 | — | — | — |
| Comp. Ex. 7 | 0.11 | — | — | — | — | — | 0.0021 | — | — | — |
| Comp. Ex. 8 | 0.07 | — | — | — | — | — | 0.0019 | — | — | — |
| Comp. Ex. 9 | 0.14 | — | — | — | — | — | 0.0020 | — | — | — |
| Comp. Ex. 10 | 0.23 | — | — | — | — | — | 0.0020 | — | — | — |

TABLE 2

| No. | Warm working start temperature | Area reduction rate in warm working | Sensitization (expression 1) | Md30 (expression 2) | GI (expression 3) |
|---|---|---|---|---|---|
| Example 1 | 740° C. | 20% | 54 | −155 | 53 |
| Example 2 | 730° C. | 15% | 53 | −151 | 59 |
| Example 3 | 740° C. | 30% | 58 | −217 | 56 |
| Example 4 | 720° C. | 20% | 52 | −127 | 52 |
| Example 5 | 740° C. | 40% | 58 | −257 | 56 |
| Example 6 | 700° C. | 15% | 51 | −121 | 51 |
| Example 7 | 740° C. | 20% | 54 | −131 | 51 |
| Example 8 | 750° C. | 40% | 59 | −196 | 55 |
| Example 9 | 750° C. | 20% | 54 | −159 | 54 |
| Example 10 | 740° C. | 20% | 56 | −202 | 56 |
| Example 11 | 750° C. | 20% | 51 | −129 | 53 |
| Example 12 | 740° C. | 20% | 51 | −127 | 56 |
| Example 13 | 740° C. | 15% | 55 | −183 | 53 |
| Example 14 | 750° C. | 20% | 54 | −126 | 53 |
| Example 15 | 730° C. | 20% | 49 | −130 | 53 |
| Example 16 | 740° C. | 40% | 57 | −170 | 54 |
| Example 17 | 740° C. | 15% | 54 | −161 | 54 |
| Comp. Ex. 1 | 930° C. | 20% | 54 | −149 | 52 |
| Comp. Ex. 2 | 730° C. | 12% | 54 | −169 | 58 |
| Comp. Ex. 3 | 710° C. | 20% | 62 | −235 | 57 |
| Comp. Ex. 4 | 730° C. | 20% | 46 | −52 | 57 |
| Comp. Ex. 5 | 740° C. | 20% | 65 | −185 | 49 |
| Comp. Ex. 6 | 740° C. | 20% | 46 | −51 | 56 |
| Comp. Ex. 7 | 730° C. | 20% | 48 | −111 | 50 |
| Comp. Ex. 8 | 740° C. | 20% | 63 | −237 | 60 |
| Comp. Ex. 9 | 730° C. | 20% | 62 | −242 | 60 |
| Comp. Ex. 10 | 710° C. | 20% | 53 | −101 | 52 |

| No. | Magnetic permeability | Tensile properties | Sensitization | CPT |
|---|---|---|---|---|
| Example 1 | A | A | Step | 75 |
| Example 2 | A | A | Step | 80 |
| Example 3 | A | A | Dual | 60 |
| Example 4 | A | A | Step | 75 |
| Example 5 | A | A | Dual | 65 |
| Example 6 | A | A | Step | 75 |
| Example 7 | A | A | Step | 75 |
| Example 8 | A | A | Dual | 60 |
| Example 9 | A | A | Step | 75 |
| Example 10 | A | A | Dual | 60 |
| Example 11 | A | A | Step | 75 |
| Example 12 | A | A | Step | 80 |
| Example 13 | A | A | Step | 75 |
| Example 14 | A | A | Step | 75 |
| Example 15 | A | A | Step | 75 |
| Example 16 | A | A | Dual | 55 |

TABLE 2-continued

| | | | | |
|---|---|---|---|---|
| Example 17 | A | A | Step | 75 |
| Comp. Ex. 1 | A | A | Ditch | 5 |
| Comp. Ex. 2 | A | C | Step | 80 |
| Comp. Ex. 3 | A | A | Ditch | 10 |
| Comp. Ex. 4 | C | C | Step | 75 |
| Comp. Ex. 5 | A | A | Ditch | 20 |
| Comp. Ex. 6 | C | A | Step | 40 |
| Comp. Ex. 7 | A | A | Step | 45 |
| Comp. Ex. 8 | A | C | Ditch | 25 |
| Comp. Ex. 9 | A | C | Ditch | 30 |
| Comp. Ex. 10 | C | A | Step | 75 |

In Examples 1 to 17, the warm working start temperature was set in the range of 800° C. to 300° C. (more specifically, 650° C. to 600° C.), the area reduction rate was set in the range of 15% to 50%, and the expression 1 to the expression 3 were all satisfied. As a result, good results were obtained in all of the magnetic permeability, the tensile properties, the sensitization test, and the CPT.

On the other hand, in Comparative Example 1, the warm working start temperature was as high as 930° C. As a result, a grooved structure was exhibited in the sensitization test, the CPT was as low as 5° C., and the corrosion resistance was poor. When the structure of the test piece in Comparative Example 1 was additionally observed, a large amount of Cr-based nitride was observed. That is, increasing the warm working start temperature to a high temperature promotes the growth of the Cr-based nitride, which is not preferred from the viewpoint of corrosion resistance.

In Comparative Example 2, the area reduction rate in the warm working was as low as 12%. As a result, the tensile properties were determined to be unsatisfactory. It is considered that this is because work hardening for the inside of the steel material was not sufficient.

In Comparative Example 3, although the content of each component was within the range described above, the component composition did not satisfy the expression 1. Reflecting this, a grooved structure was exhibited in the sensitization test and the CPT was as low as 10° C. That is, the corrosion resistance was insufficient. This indicates that satisfying the expression 1 is effective for obtaining excellent corrosion resistance.

In Comparative Example 4, the content of N was less than that in other examples, and the component composition did not satisfy the expression 2. Reflecting this, the magnetic permeability and the tensile properties were unsatisfactory. That is, the work-induced martensite transformation occurred, and the austenite single phase structure could not be maintained.

In Comparative Example 5, the content of Mo was less than that in other examples, and the component composition did not satisfy the expression 1. Reflecting this, a grooved structure was exhibited in the sensitization test and the CPT was as low as 20° C. That is, sensitization had progressed.

In Comparative Example 6, the content of Mn was less than that in other examples, and the component composition did not satisfy the expression 2. Reflecting this, the magnetic permeability was unsatisfactory and the CPT was as low as 40° C. That is, the work-induced martensite transformation occurred, and the austenite single phase structure could not be maintained.

In Comparative Example 7, the content of Cr was less than that in other examples. As a result, the CPT was as low as 45° C. That is, a short of the content of Cr leads to a deterioration in corrosion resistance.

In Comparative Example 8, the content of Cr was more than that in other examples, and the component composition did not satisfy the expression 1. Reflecting this, a grooved structure was exhibited in the sensitization test and the CPT was as low as 25° C. That is, sensitization had progressed.

In Comparative Example 9, the content of Ni was more than that in other examples, and the component composition did not satisfy the expression 1. Reflecting this, a grooved structure was exhibited in the sensitization test and the CPT was as low as 30° C. That is, sensitization had progressed.

In Comparative Example 10, although the content of each component is within the range described above, the component composition did not satisfy the expression 2. Reflecting this, the magnetic permeability is unsatisfactory (not non-magnetic). That is, the work-induced martensite transformation occurred, and the austenite single phase structure could not be maintained.

As above, in Examples 1 to 17, good results were obtained in all of the magnetic permeability, the tensile properties, the sensitization test, and the CPT. That is, it was possible to obtain a non-magnetic austenitic stainless steel material having excellent strength and corrosion resistance suitable for machine members to be used in a corrosive environment.

The composition range of a steel that can provide mechanical properties or the like substantially equal to those of the non-magnetic austenitic stainless steel material having excellent strength and corrosion resistance, including those of the above-described examples, is determined as follows.

C refines crystal grains, but may form a compound with Cr or Mo to deteriorate the corrosion resistance. Taking these into consideration, the content of C is set in the range of less than 0.10%, and preferably less than 0.05% in terms of mass %.

Si is a deoxidizing element, but excessive addition thereof lowers the hot workability and promotes the formation of a ferromagnetic phase δ ferrite. Taking these into consideration, the content of Si is set in the range of less than 0.3% in terms of mass %.

As the content of Mn increases, the addable amount of N increases, and the effect of improving the corrosion resistance due to containing N can be obtained. On the other hand, excessive addition of Mn deteriorates the corrosion resistance and promotes segregation. Taking these into consideration, the content of Mn is set in the range of more than 4.5% to less than 10.0%, and preferably more than 4.5% to less than 8.0% in terms of mass %.

P segregates at the grain boundary and impairs the workability in the hot working step and the warm working step, so that it is preferable to reduce the content thereof. Therefore, the content of P is set in the range of less than 0.05% in terms of mass %.

S segregates at the grain boundary and impairs the workability in the hot working step and the warm working step, so that it is preferable to reduce the content thereof. Therefore, the content of S is set in the range of less than 0.0020% in terms of mass %.

Cu is an impurity that is unavoidably contained from raw material scraps or the like, and segregates at the grain boundary to reduce the hot workability, so that it is preferable to reduce the content thereof. Therefore, the content of Cu is preferably set in the range of less than 1.0% in terms of mass %. On the other hand, excessive reduction thereof increases the steelmaking cost, so that the lower limit of the content of Cu can be set to 0.005% or more.

Ni is positively added because it contributes to not only the improvement of the corrosion resistance but also the improvement of non-magnetization and resistance to hydrogen embrittlement. On the other hand, excessive addition thereof increases cost, and may reduce work hardenability and increase sensitivity to sensitization. Taking these into consideration, the content of Ni is set in the range of 9.0% or more and 15.0% or less in terms of mass %.

Cr contributes to the improvement of the corrosion resistance. On the other hand, excessive addition thereof promotes the formation of a ferromagnetic phase δ ferrite and may increase the sensitivity to sensitization. Taking these into consideration, the content of Cr is set in the range of 17.0% or more and 25.0% or less in terms of mass %.

Mo contributes to the improvement of the corrosion resistance. On the other hand, excessive addition thereof promotes the formation of a ferromagnetic phase δ ferrite. Taking these into consideration, the content of Mo is set in the range of 3.0% or more and 7.0% or less, preferably more than 4.0% and 7.0% or less, and more preferably 4.5% or more and 7.0% or less in terms of mass %.

Co is an impurity that is unavoidably contained from raw material scraps or the like, and excessive content of Co may promote work-induced transformation and magnetization, so that it is preferable to reduce the content of Co. Therefore, the content of Co is preferably set in the range of less than 1.0%, and more preferably less than 0.1% in terms of mass %. On the other hand, excessive reduction thereof increases the steelmaking cost, so that the lower limit of the content of Co can be set to 0.005% or more.

B segregates at the grain boundary and can be added to prevent deterioration of the workability in the hot working step or the warm working step due to grain boundary embrittlement elements such as P and S. On the other hand, excessive addition of B causes embrittlement over the temperature range from cold to hot. Taking these into consideration, B can be added in the range of less than 0.0050% in terms of mass %.

N is positively added to form solid solution to improve the corrosion resistance and also to remarkably improve the work hardenability during the warm working. On the other hand, excessive addition thereof promotes the formation of a Cr-based nitride or the like, and may increase the sensitivity to sensitization. Taking these into consideration, the content of N is set in the range of 0.3% or more and 0.6% or less in terms of mass %.

Al is effective as a deoxidizing element, but excessive content of Al may promote the formation of a ferromagnetic phase δ ferrite, and may form a nitride to reduce the amount of solid-solution N and impair the mechanical strength or the corrosion resistance, so that it is preferable to reduce the content thereof. Therefore, the content of Al is set in the range of less than 0.1%, and preferably less than 0.01% in terms of mass %. On the other hand, excessive reduction thereof increases the steelmaking cost, so that the lower limit of the content of Al may be set to 0.005% or more.

Nb, Ti, V, and Ta form a carbide and a nitride by combining with C and N, respectively, and can be added to contribute to refinement of crystal grains. On the other hand, excessive addition thereof may reduce the amount of solid-solution N and impair the mechanical strength or the corrosion resistance. Therefore, the content of Nb is preferably set in the range of less than 0.2%, and more preferably less than 0.1% in terms of mass %. The content of Ti is preferably set less than 0.2% in terms of mass %. The content of V is preferably set in the range of less than 0.5% in terms of mass %. The content of Ta is preferably set in the range of less than 0.2% in terms of mass %.

W contributes to the improvement of the corrosion resistance, but increases the production cost due to raw material costs and may promote the formation of a ferromagnetic phase δ ferrite. Therefore, the content of W is preferably set in the range of less than 1.0%, and more preferably in the range of less than 0.1% in terms of mass %.

Ca, Mg, and Zr can be added to prevent deterioration of the workability in the hot working step or the warm working step due to grain boundary embrittlement elements such as P and S. On the other hand, excessive addition of Ca, Mg, and Zr causes embrittlement over the temperature range from cold to hot. Taking these into consideration, Ca may be added in the range of less than 0.0200% in terms of mass %. Mg may be added in the range of less than 0.0200% in terms of mass %. Zr may be added in the range of less than 0.0200% in terms of mass %.

Although representative embodiments of the present invention have been described above, the present invention is not necessarily limited thereto, and various alternative embodiments and modifications may occur to those skilled in the art without departing from the spirit of the present invention or the scope of the appended claims.

What is claimed is:

1. A non-magnetic austenitic stainless steel material:

having a component composition consisting of, in terms of mass percent:

C: <0.10%,
Si: <0.3%,
Mn: more than 4.5% to less than 10.0%,
P: <0.05%,
S: <0.0020%,
Ni: 9.0% to 15.0%,
Cr: 17.0% to 22.6%,
Mo: 3.0% to 7.0%,
N: 0.3% to 0.6%,
Nb: <0.2%,
W: <1.0%,
Al: <0.1%,
Ti: <0.2%,
V: <0.5%,
Ta: <0.2%,
B: ≤0.0050%,
Ca: <0.0200%,
Mg: <0.0200%,
Zr: <0.0200%
Cu: <1.0%, and
Co: <1.0%, with the balance being Fe and unavoidable impurities; satisfying:

$$(40[N]+1.2[Cr]+0.07\ \exp(0.3[Ni]+0.3[Cu]))\times 1.5[Mo]^{(-0.18)}\leq 60,$$

$$756-555[C]-528[N]-10.3[Si]-12.5[Mn]-10.5[Cr]-24[Ni]-5.6[Mo]\leq -110, \text{ and}$$

$$48\leq [Cr]+1.27[Ni]+3.2[Mo]+5.45[Cu],$$

in which [M] represents a content of an element M in terms of mass %;

having an austenite single phase structure;

having a critical pitting temperature of 50° C. or higher in a test method according to Method C in ASTM G48; and having a 0.2% proof stress of 970 MPa or more at a position at a depth of 1 inch from a surface in the case where a thickness T or a diameter D is 4 inches or more, or at a position at a depth of T/4 or D/4 from the surface in the case where the thickness T or the diameter D is less than 4 inches.

2. The non-magnetic austenitic stainless steel material according to claim 1, wherein the component composition further satisfies the following Group A, in terms of mass percent:

Group A: at least one element selected from Nb: <0.1%, W: <0.1%, and Al: <0.01%.

3. The non-magnetic austenitic stainless steel material according to claim 1, having a round bar shape.

4. The non-magnetic austenitic stainless steel material according to claim 3, having a warm-forged structure in which a structure is inclined from a core portion to an outer peripheral portion.

5. A steel material for a drill collar, which is obtained by boring the non-magnetic austenitic stainless steel material described in claim 4 to leave the outer peripheral portion.

6. The non-magnetic austenitic stainless steel material according to claim 1, having a hollow cylindrical shape.

7. The non-magnetic austenitic stainless steel material according to claim 1, wherein the component composition further satisfies, in terms of mass percent:

Ni: 9.0% to 13.9%.

8. The non-magnetic austenitic stainless steel material according to claim 1, wherein the component composition further satisfies, in terms of mass percent:

Mo: 4.5% to 7.0%.

9. The non-magnetic austenitic stainless steel material according to claim 1, wherein the component composition further satisfies, in terms of mass percent:

Cu: <0.35%.

10. The non-magnetic austenitic stainless steel material according to claim 1, wherein the component composition further satisfies, in terms of mass percent:

Ni: 9.0% to 13.9%, and

Mo: 4.5% to 7.0%.

11. The non-magnetic austenitic stainless steel material according to claim 1, wherein the component composition further satisfies, in terms of mass percent:

Cu: 0.35% or less.

12. A method for producing a non-magnetic austenitic stainless steel material, the material:

having a component composition consisting of, in terms of mass percent:

C: <0.10%,
Si: <0.3%,
Mn: more than 4.5% to less than 10.0%,
P: <0.05%,
S: <0.0020%,
Ni: 9.0% to 15.0%,
Cr: 17.0% to 22.6%,
Mo: 3.0% to 7.0%,
N: 0.3% to 0.6%,
Nb: <0.2%,
W: <1.0%,
Al: <0.1%,
Ti: <0.2%,
V: <0.5%,
Ta: <0.2%,
B: ≤0.0050%,
Ca: <0.0200%,
Mg: <0.0200%,
Zr: <0.0200%
Cu: <1.0%, and
Co: <1.0%, with the balance being Fe and unavoidable impurities; satisfying:

$$(40[N]+1.2[Cr]+0.07\quad\exp(0.3[Ni]+0.3[Cu]))\times 1.5[Mo]\hat{}(-0.18)\leq 60,$$

$$756-555[C]-528[N]-10.3[Si]-12.5[Mn]-10.5[Cr]-24[Ni]-5.6[Mo]\leq -110,\text{ and}$$

$$48\leq[Cr]+1.27[Ni]+3.2[Mo]+5.45[Cu],$$

in which [M] represents a content of an element M in terms of mass %;

having an austenite single phase structure;

having a critical pitting temperature of 50° C. or higher in a test method according to Method C in ASTM G48; and having a 0.2% proof stress of 970 MPa or more at a position at a depth of 1 inch from a surface in the case where a thickness T or a diameter D is 4 inches or more, or at a position at a depth of T/4 or D/4 from the surface in the case where the thickness T or the diameter D is less than 4 inches, and the method comprising:

subjecting a steel ingot having a predetermined component composition to hot working followed by a cooling treatment, and performing warm working at an area reduction rate of 15% to 50% in a temperature range of 800° C. to 300° C. during the cooling treatment.

13. The method for producing a non-magnetic austenitic stainless steel material according to claim 12, wherein the component composition further satisfies the following Group A, in terms of mass percent:

Group A: at least one element selected from Nb: <0.1%, W: <0.1%, Al: <0.01%.

14. The method for producing a non-magnetic austenitic stainless steel material according to claim 12, further comprising providing a round bar-shaped material.

15. The method for producing a non-magnetic austenitic stainless steel material according to claim 14, further comprising: boring the round bar-shaped material, to provide a steel material for a drill collar having a hollow cylindrical shape.

16. The method for producing a non-magnetic austenitic stainless steel material according to claim 12, wherein the non-magnetic austenitic stainless steel material further satisfies:

$$756-555[C]-528[N]-10.3[Si]-12.5[Mn]-10.5[Cr]-24[Ni]-5.6[Mo]\leq -110$$

in which [M] represents a content of an element M in terms of mass %.

17. The method for producing a non-magnetic austenitic stainless steel material according to claim 12, wherein the non-magnetic austenitic stainless steel material further satisfies:

$$48\leq[Cr]+1.27[Ni]+3.2[Mo]+5.45[Cu]$$

in which [M] represents a content of an element M in terms of mass %.

* * * * *